United States Patent [19]

Dearing

[11] 4,197,595

[45] Apr. 15, 1980

[54] COVER FOR SWIMMING POOLS

[76] Inventor: LeRoy M. Dearing, 12324 Ventura Blvd., Studio City, Calif. 91604

[21] Appl. No.: 852,792

[22] Filed: Nov. 18, 1977

Related U.S. Application Data

[63] Continuation of Ser. No. 611,137, Aug. 8, 1975, abandoned.

[51] Int. Cl.[2] ..... E04H 3/19

[52] U.S. Cl. ..... 4/172.12; 220/218

[58] Field of Search ..... 4/172, 172.12, 172.13, 4/172.14; 114/266, 267; 220/216, 218–227; 229/53, 55

[56] References Cited

U.S. PATENT DOCUMENTS

| | | | |
|---|---|---|---|
| 3,029,971 | 4/1962 | Reynolds | 220/218 |
| 3,191,565 | 6/1965 | Filak | 114/266 |
| 3,555,573 | 1/1971 | Turner | 4/172.12 |
| 3,728,749 | 4/1973 | Eby et al. | 114/267 X |
| 3,747,131 | 7/1973 | Koliomichalis | 4/172.12 |
| 3,872,522 | 3/1975 | Bennett et al. | 4/172.12 |
| 3,927,427 | 12/1975 | Aine | 4/172.14 |
| 3,940,809 | 3/1976 | Hughes | 4/172.12 |
| 3,984,881 | 10/1976 | Gerlach | 4/172.12 X |

*Primary Examiner*—Stuart S. Levy

[57] ABSTRACT

The disclosure is of a buoyant, air-filled, plastic cover for swimming pools, large ponds, and the like, and to facilities by which these may be constrained to float on the water (or other liquid) without proneness to disarrangement, especially in the regions of skimmers formed in the sides of the pool.

There is disclosed a pool cover subdivided into interfitting sub-sections, preferably of a rectangular shape. These are provided with coacting marginal abutments which interengage to prevent one cover section from overriding another. These abutments are in some cases of sufficient specific gravity to sink the edge portions of the cover sections somewhat deeper in the water than the remainder of the cover, which is airfilled, and of low specific gravity. Abutting, or interengaging edge elements are disclosed which mechanically engage in a confining manner, preventing overriding. The edge abutments, in one form of the invention, comprise two blocks, or strips, of a closed cell plastic foam, fastened one above and one below the margin of the cover, each of a specific gravity of approximately 0.5 to 0.6. These tend toward a stabilized position, with the upper floating essentially with the upper block above the water level and the lower below the water level.

7 Claims, 15 Drawing Figures

COVER FOR SWIMMING POOLS

This is a continuation of application Ser. No. 611,137, filed Sept. 8, 1975 now abandoned.

FIELD OF THE INVENTION

This invention relates generally to buoyant flexible covers floating on water or other liquids, and more particularly, though not essentially, to the known type, now in growing use, as a swimming pool cover, composed of two sheets of thin plastics material, sealed face to face, one of which is formed over its surface with a large number of protuberant, close-spaced cylindrical or hemispherical air-cells or bubbles, and which is buoyant so as to float on the surface of the liquid. The invention relates also to pool covers composed of, or edged with, closed or sealed cell plastic foams.

BACKGROUND OF THE INVENTION

Such cellular plastic covers have been used successfully on swimming pools, with air-cells, either cylindrical or hemispherical in form, in a range of diameters of typically 5/16" for the cylindrically shaped cells, to 1" for the hemispherical form, and of heights from about ⅛" to 5/16" for the cylindrical cells, to about 5/16" for the hemispherical form. These dimensions are given herein as examples, but in no way as limitative on the invention. The covers are preferably used with the sheet having the protuberant air-cells on the underside, projecting downward, and in the ensuing description, this orientation will be assumed, but without limitation thereto. Such covers are adapted also for use on ponds, in sizes greater than those typical of swimming pools.

Such covers, having a specific gravity less than that of water, float on the water, the upper surface of the cover riding normally at approximately from 75% to 95% of the vertical thickness of the cover (from top surface of upper sheet to bottom surface of cell) above the water line depending upon the specific gravity of the cover.

Such covers are now in fairly widespread use on swimming pools, and are known to utilize importantly solar energy for heating of the pool water, to limit evaporation, thus conserving heat otherwise lost in the evaporative process, or through heat radiation, and also conserving chemicals lost with the evaporating pool water. The cost of such a cover may be recovered by these savings within only a few months.

It has previously been proposed to subdivide swimming pool covers into separate floating units. Experience has shown, however, that the edges of unit covers often turn upwards, so as to rise above the water in local regions, and thus catch wind, which lifts or whips them higher, or partially over, and fairly large undesirable folds thus develop which disarrange the cover units, pull them back from the pool edges, separate them, overlap them, and generally shift them into non-conformature with the intended generally flat and well-fitting orientation on the pool water. Swimming pool cover units have also been proposed composed of a circular plastic sheet, bounded by an upstanding rim. These have the problem, however, that the rim, which enables them to float, like a boat, permits splash water caught in them to cause them to sink. One general purpose of the invention is to deal effectively with these problems.

BRIEF SUMMARY OF THE INVENTION

Large modern swimming pools generally have a curb which is substantially above the water level, and formed therein, or therebelow, is a depression dropping to a level just slightly below the desired pool water level. The depression comprises a horizontal skimmer wall, lip, or weir, over which water from the top level of the pool may flow to draw off a thin top layer of the pool water, along with leaves, dirt from settled dust, insects and the like. This skimmer or overflow edge can be short, such as a foot or so in length, or may run along one entire edge of the pool, or entirely therearound. The invention deals, among other things, with novel abutment arrangements of the pool cover at the edge portions thereof spanning such skimmers, as well as at marginal portions of adjacent pool cover units when the pool cover is of the sectioned type.

The pool cover of the invention may be anchored along one edge of the pool, or entirely therearound, with anchorage or tether straps spaced along the edge or edges of the pool, and leading to releasable anchorages on the side of the pool wall above the water level. A purpose of the invention is to provide weighting devices in connection with these straps for holding the corresponding edge portions of the cover securely below the water level. In general, when the pool cover anchorage straps are used, they will be needed along only one edge of the pool.

Such anchorage or tether straps along one edge of the pool cover may alternatively lead and be attached to a pool cover reel, utilized at this time as an anchorage, and using similar weighting means to keep that edge of the pool cover under water and immune from whipping up in windy weather.

If no such reel is to be used or available, the pool cover may, as a feature of the invention, be subdivided into a multiplicity of sections, all interfitting and abutting edge to edge, preferably rectangular. These sections, of reduced area, however, present additional problems, in that there is a tendency for the sections to partially override or underlap one another, and to be blown about by the wind, and a further problem and accomplishment is the provision of means by which these tendencies are overcome.

A primary feature of the invention in many of its forms, is the weighting of marginal portions of the buoyant pool cover, or pool cover sections, at spaced points therealong, to the extent that these portions ride a little lower in the water than does the buoyant air-cell cover, thus reducing the likelihood of wind entrance underneath, and resulting upward dislocation. The inventive concept includes the use, along the marginal edges of the pool cover, or of the individual pool cover sections, of interengaging sinker devices, which are preferably of such density as to lower the level at which these edge portions of the cover will ride in the water by typically about one-third to the full thickness of the cover. The interengagement may be between a sinker device on the edge of a pool cover with a side wall of the pool, e.g., just beneath the overflow lip of a skimmer or with an opposed sinker device on a contiguous pool cover unit. These devices preferably have the sinker function as explained hereinabove, so as to keep the edges of the cover or covers safely below the water level, and thus in a non-wind-catching situation. However, the devices may, in one form, simply have interengaging catch or coupler elements whose sole function is to interengage the edges of adjacent pool cover sections in a manner to prevent portions of adjacent cover sections from overriding or underriding one another, or from flipping or folding upwards. And in still another form, these abutment devices may comprise two foam plastic plates, with flattened marginal portions of contiguous covers sandwiched therebetween. By making each of these plates of a specific gravity of 0.5, this assembly floats half above and half below the water line. The invention has many further features which will be described or appear in the ensuing description and drawings.

Figure 2:
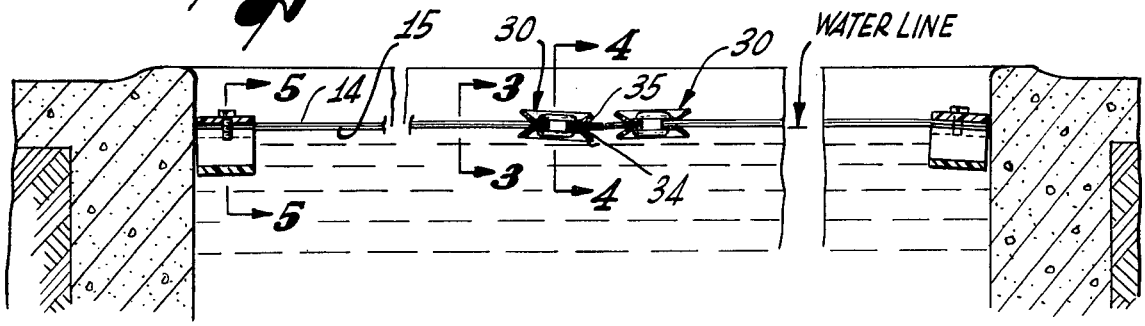
FIG. 2 is a section taken on line 2—2 of FIG. 1.
Figure 3:
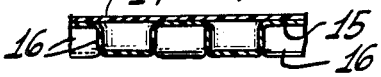
FIG. 3 is a detailed section showing the physical makeup of a preferred form of plastic air-cell cover material, such as taken on the section line 3—3 of FIG. 2.
Figure 3A:
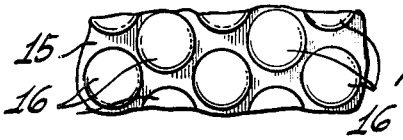
Figure 4:
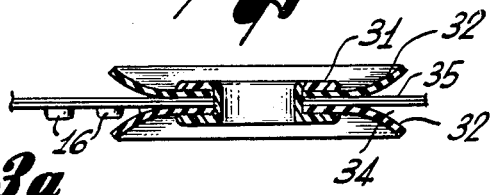
Figure 5:
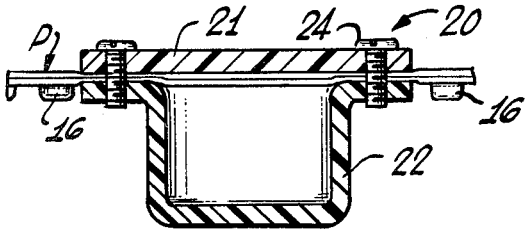
Figure 6:
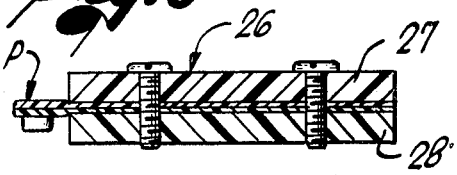
Figure 6A:
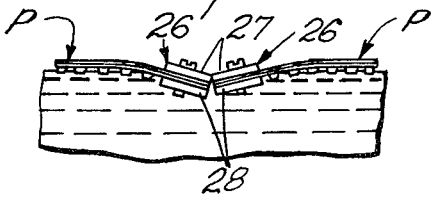
Figure 7:
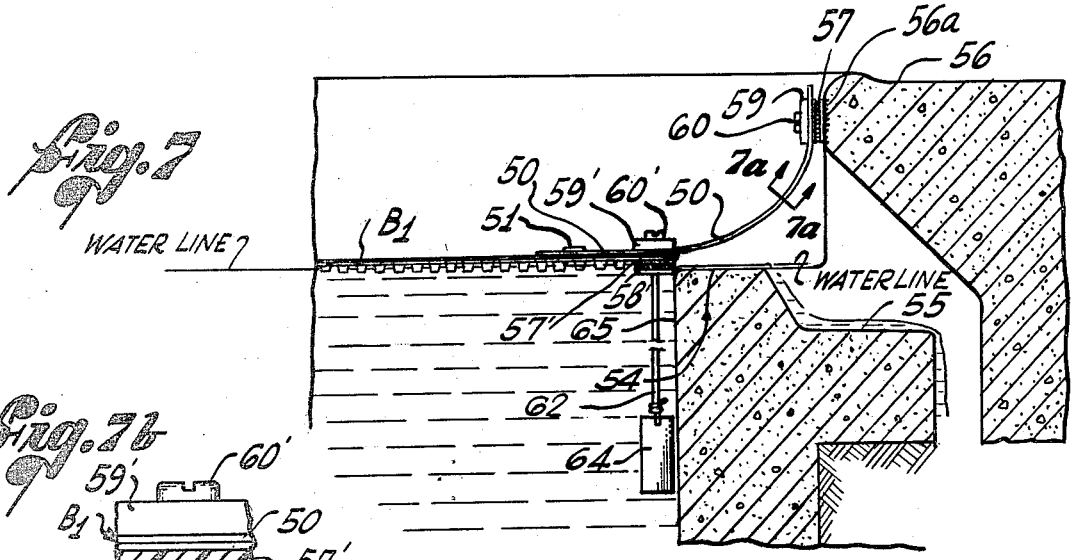
Figure 7B:
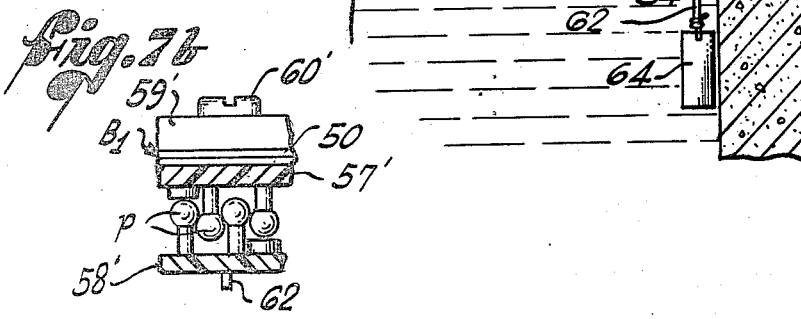
Figure 7A:
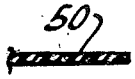
Figure 8:
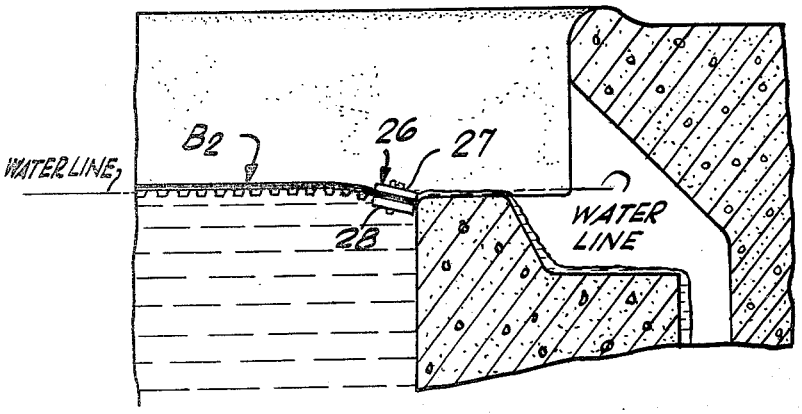
Figure 10:
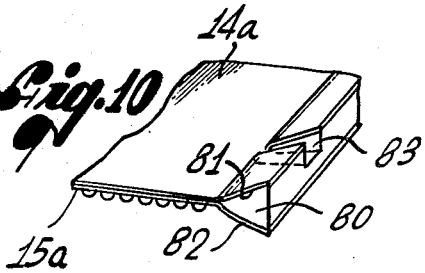
Figure 9:
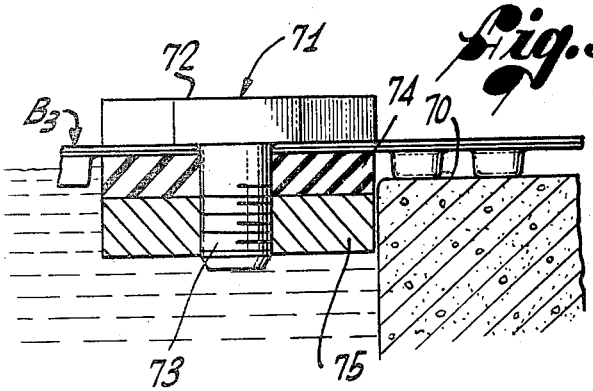
Figure 11:
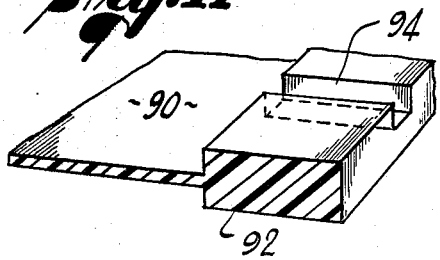

FIG. 3*a* is a fragmentary view looking upwards at the pool cover air-cell structure, as seen from below in FIG. 3;

FIG. 4 is a section taken in accordance with line 4—4 of FIG. 2;

FIG. 5 is a detailed section taken in accordance with line 5—5 of FIG. 2;

FIG. 6 is a view of an abutment device clamped to a marginal portion of the cover;

FIG. 6*a* shows two of the abutment devices of FIG. 6 in abutting relation on two contiguous cover sections;

FIG. 7 is a view showing the anchorage of the swimming pool cover adjacent and against the upper portion of the overflow curb of a typical skimmer construction used along a side wall of the pool;

FIG. 7*a* is a detail section taken as indicated by the line 7*a*—7*a* of FIG. 7;

FIG. 7*b* is a detail section of a connector or coupling device for attachment of a pool sinker, as shown in FIG. 7;

FIG. 8 is a sectional view, showing a skimmer construction similar to that of FIG. 7, but using a different type of edge abutment means on the swimming pool cover unit seen in the drawings, the latter having an abutment means of sufficient specific gravity to function as a sinker element;

FIG. 9 is a detail section showing an alternative construction of a pool edge abutment device;

FIG. 10 is a perspective view of an alternative edge bead or abutment used on a pool cover of the type shown in FIGS. 3 and 3*a;* and FIG. 11 shows a modified pool cover and peripheral bead or abutment, utilizing plastic foams for both the cover and the abutment.

DESCRIPTION OF PRESENT ILLUSTRATIVE EMBODIMENTS OF THE INVENTION

Figure 1:
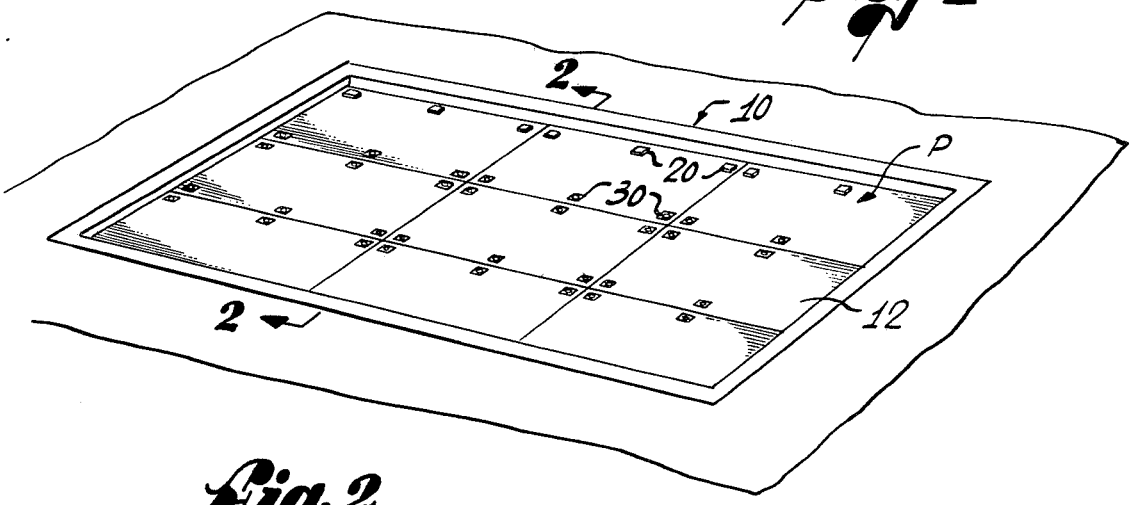
FIG. 1 is a perspective view, largely diagrammatic, showing a swimming pool with a sectional cover floating on the surface of the water.

FIG. 1 shows generally and somewhat diagrammatically at 10 a simple, rectangular swimming pool, with substantially vertical side walls 11, and which will usually have a surface skimmer, of well known design, somewhat as shown in FIG. 8, though not necessarily so in all cases.

A sectionalized buoyant plastic pool cover P floats on the surface of the pool water. That is to say, in absence of a reel or other mechanical means for removing and replacing the pool cover, and to avoid the considerable hand labor of removing and replacing the cover, it is, in one form of the present invention, subdivided into a number of individual cover units, which interfit, edge to edge, with each other, and with the edges of the pool. To this end, in the present example, the individual foldable or coilable cover sections or units 12 are preferably rectangular (inclusive of square) in shape, and may be of a typical dimension of 4' by 8' or 8' by 8'. Thus, six of such units of 4' by 8' would just cover the water surface of a small pool of 12' by 24'. Cover sections for large pools or ponds may be much larger, typically 20' by 80', and a large number of these sub-units may be assembled to cover a very large pond. Other interfitting shapes are of course available, such as hexagonal, or triangular, for example, and may be used.

Very broadly, the cover should be relatively buoyant, though of some substantial "body" or stiffness, so it will hold its relative flatness, without too much of a tendency to hump up into folds, or its corners to whip up in the wind, which is conducive to producing of vertical folds, and to overriding of the edges or corner portions of contiguous sub-units. An air-cell cover which has been on the market for some time meets the requirements when equipped with certain components and features of the invention to be described hereinafter.

The preferred cover units referred to comprise two sheets 14 and 15 of a relatively thin plastics material such as polyethylene, (see FIGS. 3 and 3*a*) the sheet 14 being preferably entirely flat, and the other sheet 15 being sealed thereto, but provided with relatively close-spaced protuberances 16, of a thick cylindrical disk shape (as here shown), or a substantially hemispherical form (not shown), as two examples. The individual sheets may have a preferred thickness of the order of 0.001" to 0.012", and the walls of the protuberant cells may be slightly thinner. The protuberances, which may be cylindrical, hemispherical, pillow form, or may be strips, blocks or sheets of sealed foam, may be formed downwardly in the sheet 15 (which is the lower sheet in the present example) by means of a die while the material of the sheet is in a plastic form, and protuberances 16 are permanently formed or set as the sheet thereafter sets or cools, as the case may be. Both sheets might of course be formed with such protuberances. Preferably, however, one sheet is flat, and the other formed with the cells; and the margins of the two sheets then brought and "welded" together by heat sealing, adhesives, or any suitable process. The sheet with the cells is often manufactured with a thin selvage, which may or may not be trimmed off for the purposes of the invention. The protuberant cells 16 will be understood to contain air, and thus to account for the buoyancy of the cover. With air cells 16 of ⅜" to 1" in diameter, and about 3/16" to 5/16" in height, the cover floats in the water with its top surface riding approximately 70 to 95% of the vertical thickness dimension of the cover above the water level, as mentioned hereinabove. A sealed or closed foam, with minute air-cells throughout, may also be used. See FIGS. 7 and 8.

The sectionalized air-cell cover, without countermeasures, is subject to unacceptable vertical folding or buckling, enabling edge and corner portions to rise above the water level; and it thus opens up entrances for wind, which in turn raises the elevated portions still higher, and the result is commonly bad disarrangement of the cover units, portions of which ride over one another, and open up wide spaces therebetween. Whole cover units can be blown around and entirely out of useful position. To the extent that this occurs, of course, the purposes of the cover units are defeated, and the appearance becomes extremely "sloppy".

According to the invention, the boundary edges of the cover units as heretofore described are afforded with continuous or suitably spaced abutment elements, and these may be fastened directly to, or suspended from, border portions of the cover units. Further, these abutment elements may be composed of a material of a higher specific gravity than that of the cover, and thus function also as sinkers. Assuming the buoyant air-filled cover to have a specific gravity of 0.05, these abutment elements may, in one preferred practice of the invention have a specific gravity at least something of the order of 0.5 or 0.6, or in some cases higher, to keep the marginal edges of the cover (which normally ride just above the water surface) at least partially under the water surface (FIGS. 6 and 8). If of a specific gravity of 0.5 and composed of two plates, with a marginal portion of the cover sandwiched between, these abutment elements float half above and half under the water level. This provision may be made whether the cover is of the one-piece type, covering the entire pool, provided the pool has a skimmer, or is of the sectional or multiple unit type, ie., characterized by a plurality of mutually edge-engageable cover sub-units.

Thus, with reference to FIGS. 1 to 5, for example, the outermost or pool-engaging edges or margins of the cover units are shown to be provided with spaced abutment elements 20, which may also be statbilizing or sinker elements. In this case, the elements 20 are in two parts, a flat plate 21 on top, and a dependent member, in this embodiment, an inverted hat-shaped or stirrup-shaped part 22, on the bottom. These members 21 and 22 receive a portion of the pool cover P between them, and are fastened tightly together, compressing the cover portion in between, as by screws 24. The air-cells in between are preferably punctured to facilitate flattening. The dependent portion of the hat-shaped part 22 affords an abutment member of substantial depth to assure engagement against the side wall of the pool across recessed regions in which a conventional swimming pool skimmer lip (not shown in FIGS. 1–5) may be located. The specific gravity of the plastics sinker elements is such as preferably to sink the marginal or edge portions of the cover unit equipped therewith by, preferably, at least substantially one-third to the full thickness of the cover, measured from flat upper surface to bottom level of air-cells. It is of course understood that the members 20 will function as stabilizers if their specific gravity is such that they will seek a given vertical position in the water, and will tend to return to that level when either depressed below that level, or elevated above it.

FIG. 6 shows an edge abutment 26, modified from that indicated at 20 in FIGS. 2 and 5, and designed for substitution in the pool cover of FIGS. 1 and 2, as an alternative for the form detailed in FIG. 4, comprising an upper plastic plate 27, similar in form to that in FIG. 5, and a lower plastic plate 28, which may be of the same material and dimensions, below. The two plates clamp the pool cover between them. If these plates are both composed of a sealed or closed plastic foam, of a specific gravity of substantially 0.5, they, together with the marginal edge portion of the cover to which they are attached, will float in the water substantially half above and half below the water level. This is a stabilized state in which the floating edge members 26 of the cover tend to return to a predetermined floating level in the water (substantially half above and half below the water level) whenever displaced either upwardly or downwardly therefrom.

When such abutments 26 are used on the margins of contiguous pool cover units (after the manner of FIG. 1), the upper plate 27 of one cover section prevents it from under-penetration of the adjacent cover section, and its under plate 28 prevents it from overriding the adjacent section. This form of the invention can have an extended range of specific gravity for the closed foam blocks. Assuming a specific gravity for the air-filled cover of say 0.05, or 0.1, the blocks may range between specific gravities of 0.2 and 0.6. If greater sinker function is desired, the specific gravity may be still further increased, affording the downwardly tilted condition shown in FIG. 8, where the unit is used to abut a pool side wall just below a skimmer surface. The foam plates 27 and 28 may be a few inches long, or continuous.

Combined sinker, abutment, and intercoupling units 30 are shown in FIGS. 1, 2 and 4, as installed at spaced locations along the interengaging or opposed of the cover units. These units may have the separate or combined functions of abutments, sinkers, stabilizers, and couplers which, if marginal portions of the contiguous cover units override one another, produce a confining interengagement which at once limits the extent of the override, and prevents the edge of either of the cover units from rising.

As shown in FIGS. 2 and 4, a two-part grommet 31 is placed in the edge portion of each of two contiguous edges of two adjacent cover sections, and under the heads thereof, above and below, are positioned centrally apertured neoprene leaves, preferably substantially square in outline. The edge portions of the cover sections are compressed flat, with intervening air-cells punctured, and the inner portions of the leaves are also placed under compression by the two heads of the grommet. The edge portions of the leaves accordingly assume a somewhat outwardly concave conformation, affording an acute angle pocket 34 between each outwardly turned leaf and the stub end, or edge 35 of the cover section opposed to that of the contiguous section. Accordingly, in the event such opposed stub ends, or edges 35 should override one another, they immediately work into the angular pockets 34, in which they are constrained against further horizontal displacement (further overlap). Additionally, once caught in such pockets, they are coupled thereby against material vertical displacement, and hence prevented from being flipped up and over, or from rising into vertical folds, such as permit wind entrance, and still further displacement. The grommet and leaf assembly is preferably made heavy or dense enough to sink the edge portions of the cover slightly, as shown, thereby keeping the opposed edge portions of the cover sections against undue rise from the uncoupled position of FIG. 2. It will be obvious also that the couplers 30, prior to intercoupling, or if they do not actually couple under some conditions, function as edge "abutments" to prevent over and underriding. As mentioned hereinabove, it is intended also, as an elective feature, to fabricate these members 30 with the appropriate characteristics to act as stabilizers, as taught hereinabove, mentioned in connection with FIG. 6. The grommets 31 in adjacent sections can be tied together by any suitable cord, or other device, providing extra security in the event of substantial wind. Such tieing is also useful when the sections are to be towed off the pool.

Reference is next directed to FIGS. 7, 7*a* and 7*b*, showing an embodiment of the invention primarily applicable to a one-piece cover, but which can be used advantageously with the sectioned type.

A cover $B_1$, preferably of the type described hereinabove, has fixed to the pool curb edge thereof, every few feet, or at any desired spacing, plastic straps 50, made fast to the cover at right angles to the edge thereof by use of plastic grommets 51.

In the case illustrated, the pool is of the type having a horizontal overflow skimmer edge or surface 54, leading to a well 55, from which skimmed pool water is returned to be filtered and recirculated, in the usual fashion. A curb portion of the deck is indicated at 56, and is set back somewhat from the skimmer surface 54, and bordered by a vertical surface 56*a*, on which is mounted the base part 57 of a pin coupler, on the market under the trademark HED-LOK, a product of 3-M Company. The upper extremity of the aforementioned strap 50 is clamped between the head 58 of this coupler and a mounting block 59, the latter being fastened to the coupler by screws such as 60. Such a coupler, which per se forms no part of the present invention, is shown to an enlarged scale in FIG. 7*b* (wherein, however, the compressed cover is also seen). There it is seen that the coupler comprises headed pins P which interengage, deflecting resiliently to permit the heads of the pins to pass one another, and then returning to a normal interlocked position as clearly shown in FIG. 7*b*. Alternatively, this end of the strap may be connected to a reel, of any conventional type, by which the pool cover may be drawn from the pool and rolled up when the pool is to be used. When the pool is not in use, the reel can serve as the anchorage for the outstretched pool cover.

As a feature of the invention, the strap 50 and cover $B_1$ may be furnished with a similar pin coupling embodying a base block 57' engaging the bottom side of the edge portion of the cover $B_1$, and fastened in place by plastic block 59', overlying the compressed cover $B_1$ and strap 50, screws 60' fastening the parts enumerated into assembly.

The lower disconnectable head 58' of the pin coupling has upstanding headed pins coacting with pins depending from the base block 57' in a manner shown in FIG. 7*b*. Suspended from connector part 58' is a cord 62 carrying a plastic sinker 64, of a density which will sink in water, and pull downwardly on the edge of the cover. The portion of the strap 50 leading from the edge of the cover $B_1$ to the connector mounted on the pool edge 56*a* is made taut enough that the base part 58' of the pin coupling is preferably constrained to ride against the pool side wall 65 just below the overflow skimmer surface 54. Thus, in this case, the edge portion of the cover is weighted so as to have a tendency to deflect downwardly, while at the same time, this downward tendency may be restrained by the connector straps 50. The sinker 64 is made heavy enough to keep the pool cover from rising above the water line, and the coupling member 58' from riding over the skimmer edge 54; and the strap 50 serves as a tether to keep the parts under restraint in the position illustrated in FIG. 7.

With the use of the connector straps, it is necessary to secure and weight the pool cover and furnish it with skimmer abutments, at one edge only, assuming it to be of the one-piece type. It can also be in one piece from the tied edge across the pool to a distance short of opposite edge by a predetermined distance, and beyond this distance, the pool can then be covered by small sectional units of the type heretofore described. These latter can be readily removed when only a limited width of the pool is to be used, say by a single swimmer.

FIG. 8 shows a pool structure like that in FIG. 7, and shows a pool cover $B_2$ like that of FIG. 7, excepting that the tether straps 50 are omitted as is the pin type coupler, and a sinker 26 of the physical form shown in FIG. 6 is used on the edge of the cover, as will be clear from the drawings. The sinker blocks 27 and 28 will be understood to be dense enough in this case to sink the edge portion of the cover to an extent, and in the abutting disposition of FIG. 8, prevent the edge portion of the cover from overriding the overflow lip of the skimmer.

FIG. 9 shows a further embodiment of the invention, the pool cover being indicated in this case at $B_3$, with its outer edge portion overlying the horizontal skimmer surface 70 to an extent. A plastic screw 71 has a large flat head 72 and a threaded shank 73 on the underside of the head 72 engages and compresses the pool cover against a rubber spacer washer 74, the cover and washer 74 being compressed by a nut 75 screwed on the shank of the screw 71. The assembly comprises an edge abutment, primarily dependent, and made of such density as to assure a degree of elevation of the top side of the cover above the water line.

FIG. 10 is a fragmentary perspective of a portion of a pool cover of the type of FIGS. 3 and 3*a*, but with an abutment bead 80 around its edges. In this case, the two plastics sheets 14*a* and 15*a* have selvages 81 and 82, i.e., marginal edge portions devoid of air-cells, spread apart upwards and downwards, and in between is cemented or heat-welded a bead 80 of plastics material. This bead may run continuously around the cover section, excepting for drainage notches 83, sinking to the level of the top side of the cover, and which enable escape of splashed-in water. These drainage notches may be spaced every few inches along the bead. They need not be open topped, since an equivalent drainage opening would be a succession of tunnels through the bead at the water line. The bead may rise for say an inch above the cover, and drop an inch below. The bead is preferably composed of a plastics material, for example, a sealed or closed cell foam, and preferably has a specific gravity around 0.5, so that the cover tends to float with its upper surface substantially at the water line. The bead thus functions as a stabilizer. The bead 80 may also be of denser material, so as to have a sinking tendency causing it to float a little lower in the water. This form of the invention may be used with its abutment bead either against a side wall of the pool, or against an abutment of an adjacent cover section.

FIG. 11 shows a fragmentary portion of a cover composed of a closed or sealed foam plastics sheet 90, of a specific gravity of approximately 0.05, to have buoyancy combined with stability, and a thickness of say $\frac{1}{8}''$ to $\frac{3}{8}''$, and a circumscribing abutment bead 92, with a thickness say two to five times that of the sheet 90, both above and below the latter, and with a preferred specific gravity of 0.5. These dimensions are not intended as necessarily limitative on the invention, but only as illustrative of one practice of the invention. The bead has channels 94 leading horizontally therethrough from the upper surface of the cover, to enable escape of splashed-in water, as in FIG. 10. This form of the invention, with different densities in the cover and bead or abutment portions thereof, may be made initially in two parts, sealing or joining adhesively afterwards. And, as taught hereinabove, with increase in specific gravity of the bead, the function of a sinker is added. This form of the invention may be used with its abutment bead either against a side wall of the pool, or against an abutment of an adjacent cover section.

From the foregoing it will be evident that I have provided improvements in pool covers which maintain the cover in a stable position of flotation on the surface of the water with partial immersion below the water line to prevent vertical folds and elevations permitting wind to enter below and disarrange the cover. While the invention may be used in connection with a reel, and in this case, or in others, the pool cover may be fabricated in one piece, I have made possible a cover formed in easily handled sections, so that installation of a reel may be avoided. I have, moreover, made arrangements by which the pool cover sections will stay in their intended positions, edge-to-edge, without tendency to flip up or rise in the wind, and with a built-in tendency to abut one another, edge-to-edge, rather than to override one another, and thus go into a badly disarranged condition.

It will of course be understood that the drawings and description of preferred embodiments is for illustrative purposes only and that many modifications may be made without departing from the spirit and scope of the appended claims.

I claim:

1. A cover to float on the water surface of a swimming pool comprising:

a plurality of separate foldable or coilable cover sections formed of flexible buoyant plastic material including a multiplicity of air cells and having peripheral marginal portions normally adjacent to and just above the water surface, the area of said sections between said marginal portions floating on the water surface, said sections being shaped and dimensioned to be assembled in contiguous relation to one another on said water surface so that some of said marginal portions form mutually opposing edges; and a plurality of discrete buoyant abutment elements of greater density than said sections disposed at spaced apart locations along the edges of and within the confines of said marginal portions, at least some of said abutment elements being disposed on those marginal portions that form opposing edges and being arranged for engagement with the abutment elements on an opposing edge of an adjacent section;

said abutment elements including first members each comprising a plate overlying the top surface of one of said sections, second members each comprising a plate underlying the bottom surface of said one of said sections, and fastening means for rigidly connecting said plates to said sections;

said abutment elements defining mutually interlockable pocket means formed by spaced apart portions of outer edges of said plates for limiting relative vertical displacement of opposing adjacent sections.

2. The cover of claim 1, wherein said sections each comprise two thin plastic sheets bonded together, at least one of said sheets forming said air cells, said sections having a buoyancy such that they ride in the water with 70% to 95% of their vertical height above the water line.

3. The cover of claim 1, wherein the specific gravity of said abutment elements is such as to cause them to float partially above and partially below the water surface.

4. The cover of claim 1, wherein said abutment elements have a specific gravity in the approximate range of 0.5 to 0.6.

5. The cover of claim 1, further comprising a plurality of spaced-apart discrete sinker means disposed along marginal portions of said section that do not form opposing edges for submerging those marginal portions.

6. A cover to float on the water surface of a swimming pool comprising:

a plurality of separate foldable or coilable rectangular cover sections formed of flexible buoyant plastic material formed by two thin plastic sheets bonded together, at least one of said sheets defining a plurality of horizontally distributed air cells, said sections having a buoyancy such that they ride in the water with 70 percent to 95 percent of their vertical height above the water line, said sections having peripheral marginal portions normally adjacent and just above the water surface, the areas of said sections between said marginal portions floating on the water surface, said sections being adapted to be assembled to contiguous relation to one another on said water surface so that some of said marginal portions form mutually opposing edges;

a plurality of discrete abutment elements disposed at spaced-apart locations along the edges of and within the confines of said opposing edges and arranged for engagement with the abutments elements on an opposing edge of an adjacent section; and each of said abutment elements having a first member comprising a plate overlying the top surface of one of said sections, a second member comprising a plate underlying the bottom surface of said section, and fastening means for rigidly connecting said plates, at least some of said members defining indented pocket means formed by spaced apart portions of outer edges of said plates for preventing vertical displacement of an opposing section.

7. A cover to float on the water surface of a swimming pool comprising:

a plurality of separate foldable or coilable cover sections formed of flexible buoyant plastic material including a multiplicity of air cells and having peripheral marginal portions normally adjacent and just above the water surface, the area of said sections between said marginal portions floating on the water surface, said sections being adapted to be assembled in contiguous relation to one another on said water surface so that some of said marginal portions form mutually opposing edges; and a plurality of discrete buoyant abutment elements of greater density than said sections disposed at spaced apart locations along the edges of and within the confines of said marginal portions, at least some of said abutment elements being disposed on those marginal portions that form opposing edges and being arranged for engagement with the abutment elements on an opposing edge of an adjacent section;

said abutment elements including first members each comprising a plate overlying the top surface of one of said sections, second members each comprising a plate underlying the bottom surface of said one of said sections, and fastening means for rigidly connecting said plates to said sections;

said abutment elements defining mutually interlockable pocket means formed by spaced apart portions of outer edges of said plates for limiting relative vertical displacement of opposing adjacent sections, said abutment elements defining water passage means for preventing accumulation of water therein.

* * * * *